United States Patent [19]

Lohn

[11] Patent Number: 4,570,890

[45] Date of Patent: Feb. 18, 1986

[54] UNIVERSAL HOLDER FOR MOUNTING HANDGUNS REMOTE FROM THE USER

[76] Inventor: Edwin E. Lohn, 9 Middleridge Lane South, Rolling Hills, Calif. 90274

[21] Appl. No.: 604,247

[22] Filed: Apr. 26, 1984

[51] Int. Cl.[4] ..... E04G 3/00

[52] U.S. Cl. ..... 248/274; 248/309.2

[58] Field of Search ..... 248/274, 284, 287, 291, 248/309.2; 224/912; 403/116, 113; 269/65, 69

[56] References Cited

U.S. PATENT DOCUMENTS

| | | | |
|---|---|---|---|
| 1,017,607 | 2/1912 | Turk | 248/291 |
| 1,323,489 | 12/1919 | Prescott | 248/291 X |
| 1,579,552 | 4/1926 | Ludlow | 224/912 X |
| 2,366,385 | 1/1945 | Comfort | 269/69 X |
| 2,401,174 | 5/1946 | McAuley | 224/912 X |
| 3,282,437 | 11/1966 | Hansen | 211/41 |
| 4,050,662 | 9/1977 | Pickering | 248/309.2 X |

FOREIGN PATENT DOCUMENTS

| | | | |
|---|---|---|---|
| 2042056 | 9/1980 | United Kingdom | 248/287 |

*Primary Examiner*—Ramon S. Britts
*Assistant Examiner*—David M. Purol
*Attorney, Agent, or Firm*—Nilsson, Robbins, Dalgarn, Berliner, Carson & Wurst

[57] ABSTRACT

A handgun holder is adapted for use in conjunction with an apparatus having a surface adjacent which a handgun is to be positioned for easy retrieval. The holder includes: rod structure for receiving a handgun barrel by extending into the barrel; support structure to rigidly hold the rod structure in a desired position adjacent such surface; pin structure extending outwardly from the support structure adjacent the rod structure for engaging the gun sight on the handgun to hold the grip of the handgun at a predetermined angle with respect to such surface; and structure for securing the support structure to such surface.

10 Claims, 9 Drawing Figures

UNIVERSAL HOLDER FOR MOUNTING HANDGUNS REMOTE FROM THE USER

BACKGROUND OF THE INVENTION

This invention relates to handgun holding devices and more particularly to such a device useful for holding a handgun remote from the user and ready for easy retrieval and use should the occasion arise.

The best prior art known to applicant is shown in U.S. Pat. Nos. 1,557,339, 1,579,552, 1,969,258, 2,401,174, 2,764,326 and 3,796,358. U.S. Pat. No. 1,557,339 is directed to a pistol holding device useful for concealing a handgun in the instrument panel of an automobile with apparatus to project the handgun from the instrument panel as needed. U.S. Pat. No. 3,796,358 is directed to a holster or a table mounted bracket which contains a spindle over which the barrel of a handgun fits. U.S. Pat. No. 2,764,326 contains a structure similar to that shown in U.S. Pat. No. 2,764,326 but which is carried upon a belt and functions as a holster. U.S. Pat. No. 2,401,174 also discloses a holster device which may include a barrel spindle. U.S. Pat. No. 1,579,552 discloses a handgun holder which may be mounted on furniture and, in addition to a barrel spindle, includes gripping arms which contact the outside of the pistol barrel. U.S.Pat. No. 1,969,258 discloses a device holding a holster of conventional type which receives a handgun therein. None of the prior art known to applicant solves the problem of supporting a handgun in a readily accessible position so that the handgun grip is at a position most readily accessible to the user and is adjustable to a position desired by the user.

At the present time, many individuals have found it very desirable to have handquns readily accessible in their homes or at their places of business for personal security. To make handguns useful for personal security they must be secured in a position within easy reach of the user and disposed at the particular angle which the user finds will most accommodate him under the particular circumstances of use. It is also important that the handgun be secured such that it is out of sight. The prior art references above identified and briefly described do not provide a solution to these problems.

SUMMARY OF THE INVENTION

A handgun holder for use in conjunction with a surface adjacent which the handgun is to be positioned for easy retrieval, including a rod means for receiving a handgun barrel supported upon means adapted for attachment to the surface and pin means extending outwardly from the support to engage the gun sight so as to hold the grip of the handgun at a desired angle with respect to the surface.

DESCRIPTION OF THE INVENTION

Figure 1:
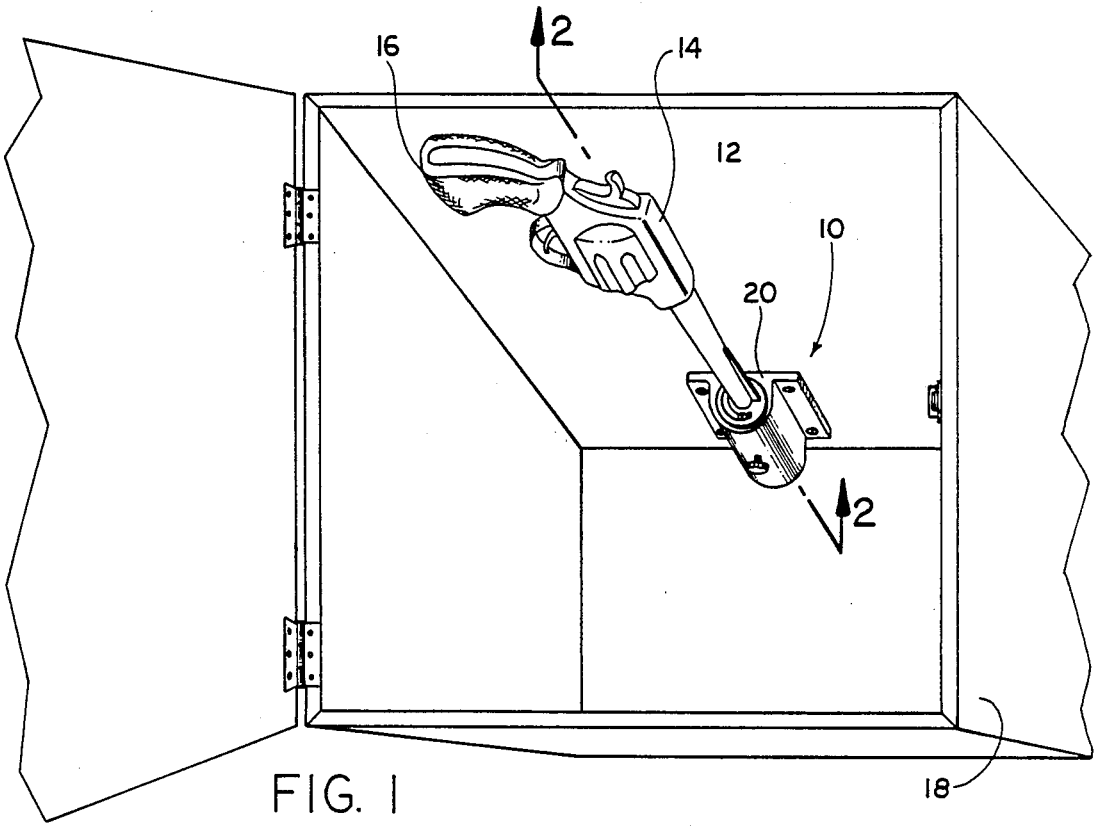
FIG. 1 is a perspective view of a handgun positioned upon a handgun holder disposed within a cabinet or similar structure.

There is illustrated in FIG. 1 a universal holder shown generally at 10 which is secured to a substantially horizontal surface 12 for receiving a handgun 14 with the grip 16 thereof positioned such that a person on the left side thereof can quickly grasp the grip 16 and retrieve it from the holder 10, immediately ready for use.

The surface 12 is illustrated as being part of a cabinet 18, such for example as a typical night stand or the like. It should, however, be understood that the surface 12 may be provided by any structure desired and may be at any angle desired. For example, it may be part of a counter behind which a merchant works, a surface beneath a ticket booth or bank teller's station or the like. In any event, all that is required is the provision of a surface adjacent which the handgun may be preferably disposed out of sight but in a position for immediate use. An important feature of the present invention is that the grip of the handgun be positioned for easy access and immediate use by the user. As illustrated in FIG. 1 a righthanded person positioned to the left of the surface 12, either standing or lying down, could immediately reach out and grasp the grip 16 of the handgun 14 and remove it from the support 10 for immediate use. The holder 10 of the present invention is constructed such that the handgun may be positioned with the grip angularly disposed at any desired position with respect to the surface 12 so that access is immediately available, irrespective of the conditions of use. The fundamental principle involved is that gravity acts on the gun butt to hold the grip in the desired position with respect to the surface to accommodate the user.

Figure 2:
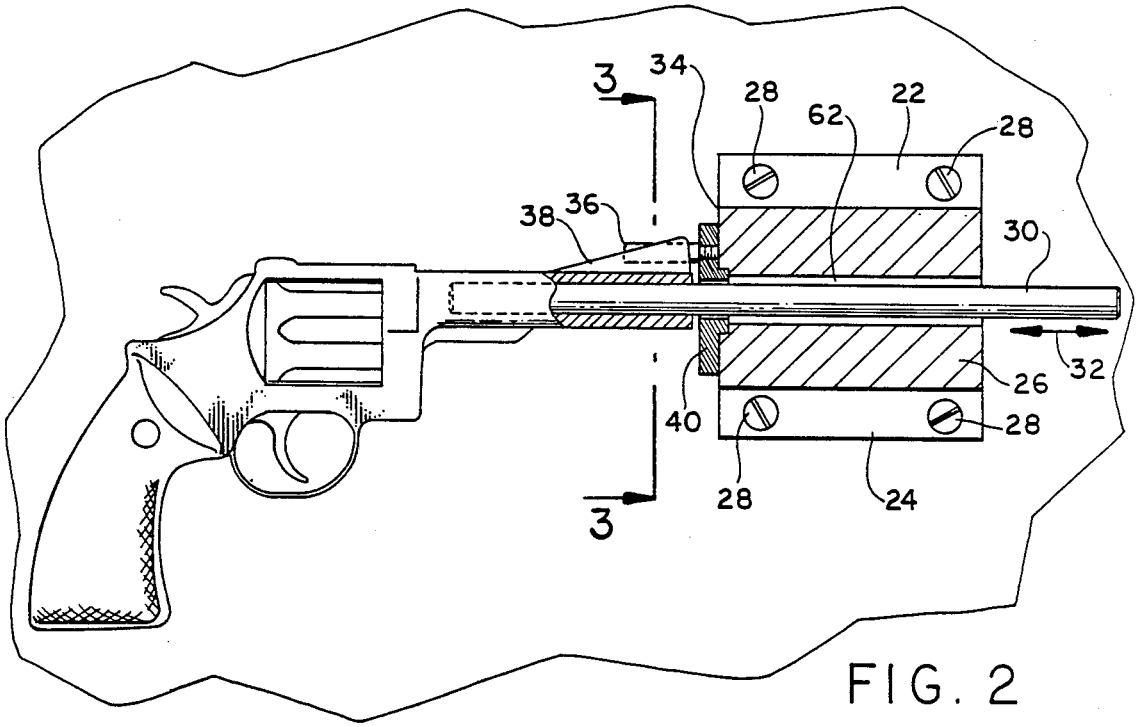
FIG. 2 is a bottom view, partly in section, of the structure illustrated in FIG. 1 and taken about the lines 2—2 thereof.

As is illustrated more clearly in FIG. 2, the holder 10 includes a support means 20 having a pair of flanges 22 and 24 extending outwardly from the body 26 thereof. The flanges 22 and 24 define openings through which fastening devices such as screws or bolts 28 may be passed to secure the holder 10 to the surface 12.

A rod means 30 is secured by the support means 20 so that the rod means 30 is disposed in this instance in a horizontal position beneath the surface 12. As is illustrated in FIG. 2 by the arrow 32 the rod means 30 may be adjusted so that more or less thereof extends from the face 34 of the support means 20. By such adjustment, handguns having barrels of different lengths may easily be accommodated by the universal holder constructed in accordance with the principles of the present invention.

Figure 3A:
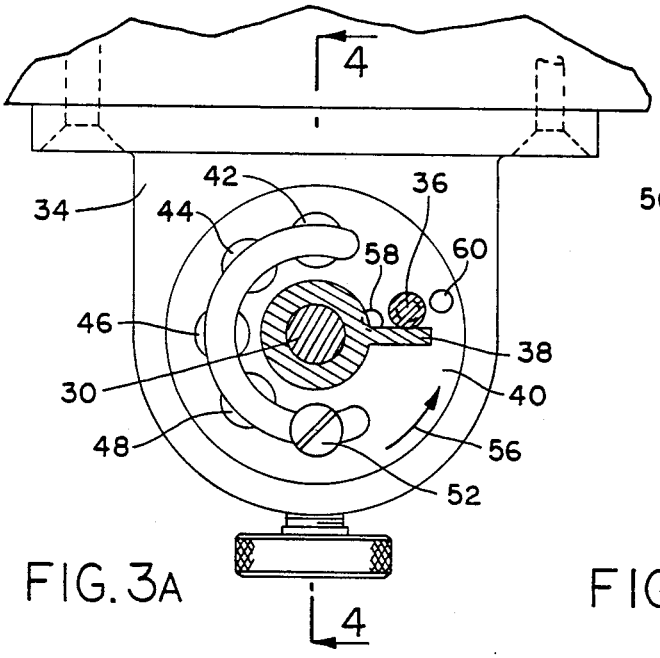
FIGS. 3A and 3B are front views of the apparatus shown in FIGS. 1 and 2, partly in section, taken about the lines 3—3 of FIG. 2 and illustrating the handgun in two different positions.
Figure 3B:
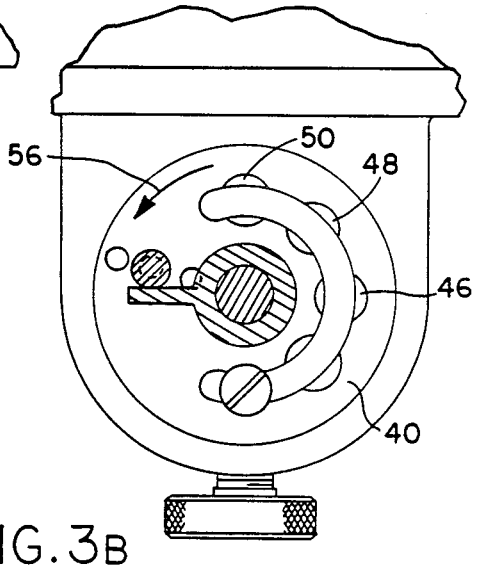
Figure 4:
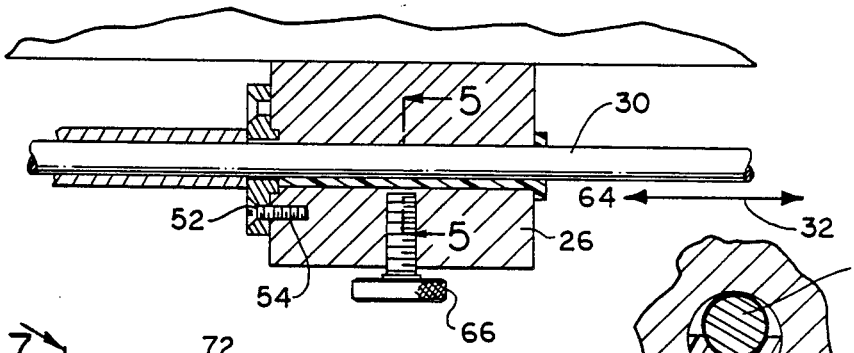
FIG. 4 is a sectional side view taken about the lines 4—4 of FIG. 3A illustrating the rod for holding the barrel of a handgun and the means for securing it on a supporting apparatus.
Figure 5:
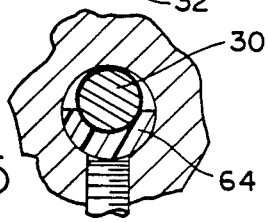
FIG. 5 is a cross sectional view taken about the lines 5—5 of FIG. 4 further illustrating means for positioning rods of various sizes within the handgun holder of the present invention.

The position of the grip 16 of the handgun 14 with respect to the surface 12 is defined by pin means 36 which extend outwardly from the surface 34 of the support means 20 in such a manner that the gun sight 38 engages the pin means thus precluding the force of gravity from rotating the grip 16 of the handgun into a vertically disposed position which obviously would occur in the absence of the pin 36. The position of the pin 36 in angular relation to the rod 30 is adjustable as shown in FIGS. 3A and 3B to accommodate the desires of any user. FIG. 3A illustrates the position of the pin 36 with the handgun disposed as illustrated in FIGS. 1 and 2. FIG. 3B, on the other hand, illustrates the position of the pin 36 as it would appear if the grip 16 of the handgun were rotated 180 degrees, counterclockwise, as viewed in FIG. 1. To accommodate such adjustability of the universal holder 10 there is provided a plate 40 which defines a plurality of openings 42 through 50 therein. A securing means such as a screw 52 is provided and is secured within a threaded opening 54 formed in the body 26 of the support means 20. To obtain adjustability of the position of the grip 16 on the handgun 14 the screw or bolt 52 would be removed from the threaded opening 54 and the plate 40 rotated, for example, so that the opening 48 is aligned with the threaded opening 54, after which the bolt 52 would be secured in place holding the plate 40. After such adjustment the barrel of the handgun would be placed over the rod 30 with the sight 38 against the pin 36 and the grip 16 would be disposed at an angle of approximately 45 degrees with respect to the surface 12. Such additional adjustments may occur by rotation of the plate 40 as shown by the arrows 56 to any desired position.

It should also be noted that the pin 36 may be positioned in different openings as shown at 58 and 60 from that in which it is secured. The pin 36 may thus be adjusted radially as well as angularly with respect to the rod 30 thereby accommodating different types of handguns with different types of sights thereon.

The rod 30 is secured in place in an opening 62 provided in the body 26 of the support means 20. An insert 64 may be positioned within the opening 62 to accommodate rods 30 which have a size smaller than the size of the opening 62. By the capability of utilizing different rods, different size pistols having different size barrels may be accommodated in the universal holder constructed in accordance with the present invention. In any event, whether the rod 30 is of the same size as the opening 62 or if an insert 64 is used, once the position of the rod has been determined by moving it as is illustrated by the arrow 32, a thumb screw 66 is tightened down to secure the rod 30 in place.

It can thus be seen that after installation of the holder 10 upon the surface 12 with the fasteners 28, the plate 40 is adjusted to obtain the desired angular disposition for the grip of the handgun to suit the desires of the user and then the rod 30 is adjusted to accommodate the size and length of the barrel of the handgun and the pin 36 is adjusted to accommodate the sight of the handgun. As can be seen through such simple adjustments a wide variety of handguns may be accommodated in any position desired by the user to meet with his or her particular desires.

Figure 6:
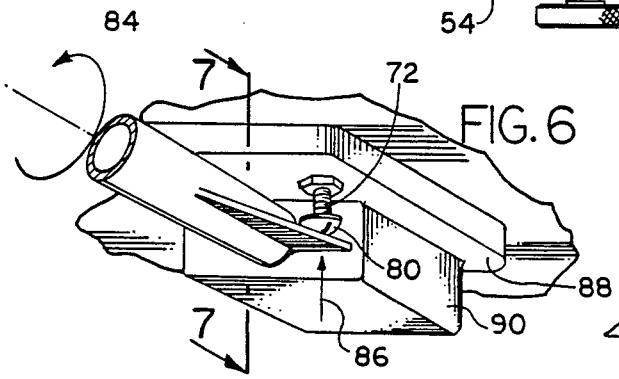
FIGS. 6 and 7 illustrate an alternative embodiment of a handgun holder constructed in accordance with the principles of the present invention.
Figure 7:
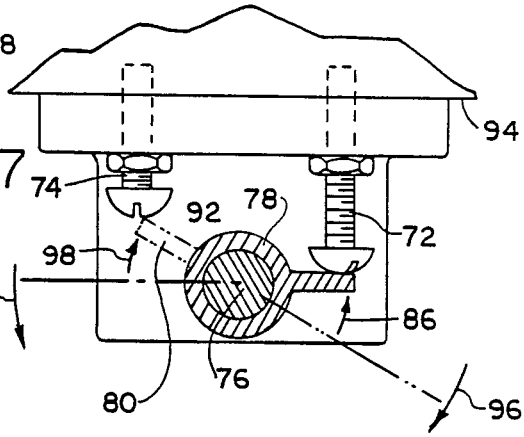

Referring now to FIGS. 6 and 7 a simplified structure embodying the principles of the holder of the present invention is illustrated. As is shown in FIGS. 6 and 7, the pin may take the form of a bolt or screw 72 and 74 which are positioned orthogonally to the rod 76 upon which the barrel 78 of the handgun rests. The sight 80 on the handgun abuts the head 82 of the bolt 72. As will be recognized the force of gravity acting on the weight of the grip on the handgun will apply a counterclockwise force as shown by the arrow 84 causing the sight 80 to tend to be urged upwardly as shown by the arrow 86 into engagement with the head 82. By screwing the bolt 72 further into or further away from the surface 88 of the support means 90, the desired angle of disposition of the grip on the handgun may be obtained.

The latter point is more fully illustrated in FIG. 7 which further illustrates that if the handgun is moved so that the grip thereof is toward the right as viewed in FIG. 7, then the sight 80 abuts the head 92 of the bolt 74 and since the bolt 74 has been screwed further toward the surface 88, the gun grip would be disposed at approximately 45 degrees with respect to the surface 94 upon which the holder is secured. Under these circumstances, the forces generated by the weight of the grip would be in the direction as shown by the arrow 96 causing the sight 80 to be urged upwardly as shown by the arrow 98 against the head 92 of the bolt 74. It will be obvious to those skilled in the art that there is an infinite amount of adjustability provided by the bolts 72 and 74 to accommodate the particular angular disposition of the grip of the handgun as may be desired by any user.

Figure 8:
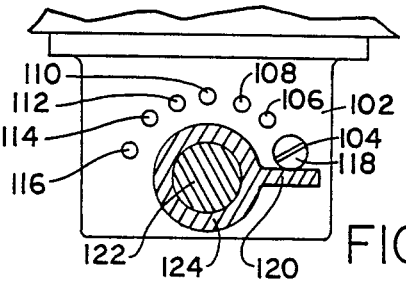
FIG. 8 illustrates yet a further embodiment of a handgun holder constructed in accordance with the present invention.

By reference now to FIG. 8 there is illustrated yet a further simplified version of the holder constructed in accordance with the present invention. As is illustrated in FIG. 8 the body 102 defines a plurality of openings 104 through 116 therein. A screw or bolt 118 may be positioned in any one of the openings 104 through 116 to accommodate the desired angular positioning of the grip of the handgun so that the sight 120 thereof will bear against the head of the bolt 118 to accommodate the angular disposition of the handgun on the rod 122 which supports the barrel 124 of the handgun.

There has thus been disclosed a universal handgun holder, fully adjustable to accommodate various sizes and types of handguns in various positions readily accessible to a user, yet remote from the body of the user at all times.

What is claimed is:

1. A handgun holder in combination with a handgun having a gunsight and a hand grip for use in conjunction with an apparatus having a surface adjacent which said handgun is to be positioned out of sight for easy retrieval, said combination comprising:

(A) rod means receiving a barrel of said handgun by extending into said barrel to support the weight of said handgun while allowing a user to quickly and easily remove said handgun therefrom by grasping the grip and withdrawing the gun barrel from the rod;

(B) support means rigidly holding said rod means in a position spaced from said surface by an amount to receive the barrel of said handgun between said surface and said rod in a non-interfering manner;

(C) pin means extending outwardly from said support means adjacent said rod means engaging the gun sight on said handgun in a non-fixed relationship to hold the grip of said handgun at a predetermined angle other than 90 degrees with respect to said surface the engagement between the gun sight and the pin means being the only means for retaining said grip at said predetermined angle; and (D) means for fixedly securing said support means to said surface.

2. The combination holder as defined in claim 1 wherein said pin means is adjustable with respect to said rod means for changing said predetermined angle.

3. The combination as defined in claim 2 wherein said support means defines a plurality of openings angularly disposed about said rod means, said pin means being positionable in one of said openings to obtain a desired predetermined angle.

4. The combination as defined in claim 2 which further includes plate means rotatably mounted on said support means, said plate means carrying said pin means, and means for securing said plate means against rotation after a desired predetermined angle has been determined.

5. The combination as defined in claim 2 which further includes meanss for radially adjusting said pin means with respect to said rod means to accommodate different hahdguns having different gun sights thereon.

6. The combination as defined in claim 2 wherein said support means defines a bore therethrough, said rod means being received within said bore.

7. The combination as defined in claim 2 wherein said pin means is disposed orthogonally with respect to said rod means.

8. The combination as defined in claim 2 wherein said pin means is disposed parallel to said rod means.

9. The combination as defined in claim 6 wherein said rod means is longitudinally adjustable within said bore and which further includes clamping means to secure said rod means to said support means.

10. The combination as defined in claim 4 wherein said plate means defines a centrally disposed opening therethrough, said rod means being received within said opening, said plate means further defining a plurality of openings radially disposed equidistant from said central opening, said support means defining a threaded opening radially disposed said equidistance from said central opening, a threaded member received within said threaded opening and passing through one of said openings in said plate means for securing said plate means.

* * * * *